United States Patent [19]

Twyford

[11] 4,433,317

[45] Feb. 21, 1984

[54] CONTROLLED FLOATING CONTACTOR SWITCH

[75] Inventor: Robert H. Twyford, Great Falls, Va.

[73] Assignee: Mechanical Enterprises, Inc., Herndon, Va.

[21] Appl. No.: 450,227

[22] Filed: Dec. 16, 1982

Related U.S. Application Data

[63] Continuation-in-part of Ser. No. 340,366, Jan. 18, 1982, abandoned.

[51] Int. Cl.[3] ..... H01H 1/66; H01H 51/00

[52] U.S. Cl. ..... 335/151; 200/61.45 R; 200/DIG. 29; 335/280

[58] Field of Search ..... 335/151, 280, 82; 200/61.45, DIG. 29

[56] References Cited

U.S. PATENT DOCUMENTS

| | | | |
|---|---|---|---|
| 1,964,954 | 7/1934 | Leins | 200/277 |
| 2,921,163 | 1/1960 | Pfleiderer | 335/151 |
| 3,790,732 | 2/1974 | Slamecka et al. | 200/277 |
| 3,812,308 | 5/1974 | Bell et al. | 200/61.45 |
| 3,889,774 | 6/1975 | Schwenk | 200/DIG. 29 |
| 3,927,286 | 12/1975 | Fohl | 200/61.45 |
| 4,115,995 | 9/1978 | Brien | 200/61.45 |

FOREIGN PATENT DOCUMENTS

| | | | |
|---|---|---|---|
| 956432 | 4/1964 | United Kingdom | 335/280 |

*Primary Examiner*—Harold Broome

*Attorney, Agent, or Firm*—Schuyler, Banner, Birch, McKie & Beckett

[57] ABSTRACT

A miniaturized switch particularly suitable for electronic keyboard control applications has a pair of contact members providing spaced contacts, a conductive floating contactor disposed in the space between such contacts adapted to engage both of the contacts to close the switch, a resilient sleeve enclosing the contacts and the space therebetween to encircle the contactor, and actuator means to displace the contactor within the sleeve relative to the contacts to effect closing of the switch.

13 Claims, 7 Drawing Figures

CONTROLLED FLOATING CONTACTOR SWITCH

RELATED APPLICATION

This is a continuation-in-part of application Ser. No. 340,366, filed Jan. 18, 1982, now abandoned.

BACKGROUND OF THE INVENTION

This invention relates generally to minaturized switches which are frequently employed in keyboards for controlling electronic equipment involving low voltage and low current use applications.

A multitude of keyboard applications exist wherein keys or push buttons on a keyboard effect actuation of switches that are integrated into electronic circuits for carrying out a variety of computer or data processing operations. These range from keyboard applications in pocket calculators to both local and remote computer terminals. The cost of such keyboards is indeed a significant factor when the substantial number of terminals, input devices and other peripheral equipment uses in computer and data processing applications are considered. Further, large volume demand for minaturized electric switches occurs in solid state adding machines and calculators embracing desk top models ranging down to small pocket size calculators.

A variety of switch constructions suitable for keyboards of the types mentioned above, have been developed in a wide range of both mechanical-electrical configurations and elaborate electronic switching concepts. Particularly, in the minaturized switches needed for the very small and now low cost pocket size calculators, the large volume of keyboards needed makes cost in the keyboard construction a critical factor. Thus, the miniaturized switches must involve a low initial investment, be maintenance free in operation and possess high operational reliability. Meeting all of these criteria has indeed been a major problem in the development of miniaturized electrical switches.

SUMMARY OF THE INVENTION

A principal object of the present invention is the provision of a miniaturized electrical switch for generating electrically significant data where utilization of a multiple of such switches in keyboard applications such as computers, calculators, etc. is necessary.

A further primary object of the instant invention is to provide a very low-cost but highly reliable miniaturized switch wherein minimal relative movement between the switch contact members occurs between switch open and closed conditions.

A further object is to provide a low-cost switch characterized by a long life and incorporating a minimum of required parts.

It is also an object of the invention to provide a miniaturized switch that incorporates a resilient component through which switch actuating force may be transmitted whereby this component lends the switch the capability of dissipating excess actuating force without unduly forcing the switch contact members into closing engagement with each other.

Another important object of this invention is the provision of a sleeve enclosing the contact members such as to exclude their exposure to deleterious atmospheric or environmental conditions which could promote corrosion or other damage to the contact members and diminish the life expectancy for the switch.

Also an important object of the invention is to provide a switch in accordance with the above object wherein the sleeve is resilient and encloses a floating conductive contactor member disposed between the contact members to contribute controlled support for the contactor member.

An additional object contemplates a switch in accordance with the above object wherein the floating contactor member, encircled by the resilient sleeve, is characterized by separate elements that are controlled in their movement by the sleeve resiliency so as to supplement dissipation of any excess actuating force applied to the sleeve exterior with consequent controlled movement of the elements of the contactor member.

The invention herein achieves the above-mentioned objects, aims and purposes by having a pair of contact members mounted in the cavity of a switch housing that provide spaced contacts with a conductive floating contactor member disposed in the space between such contacts adapted to engage both of the contacts to close the switch and a resilient sleeve enclosing the contacts and the space therebetween to encircle this conductive member. Preferably, the contacts are provided by opposed conical ends on the contacts and the contactor member is provided by a spherical element or separate spherical elements.

The miniaturized switch of the invention may be mechanically or magnetically operated with the actuator means in either case acting to displace the contactor within the sleeve relative to the contacts to effect closing of the switch. A particular form of actuator means may be provided by a trigger means movably carried by the switch housing to apply force generally radially to the exterior of the resilient sleeve so as to displace the contactor within such sleeve.

In the miniaturized switch invention, the contacts and conductive contactor are totally enclosed within the resilient sleeve in the manner described above such that the electrically conductive parts of the switch are fully protected against the deleterious effects of environmental conditions to which the switch may be exposed in use. Advantageously the switch parts enclosed within the resilient sleeve may be silver plated for benefits to be gained in switch operation but without fear of these silver plated parts tarnishing to shorten switch life expectancy.

BRIEF DESCRIPTION OF THE DRAWING

The foregoing objects, as well as others, will become apparent through consideration of the following detailed description of the invention given in connection with the accompanying illustrations on the drawing in which.

DETAILED DESCRIPTION OF ILLUSTRATIVE PREFERRED EMBODIMENTS

Figure 1:
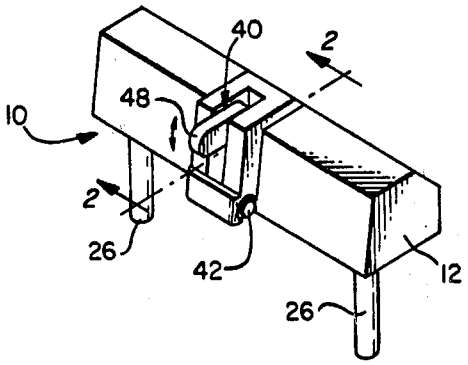
FIG. 1 is a perspective view of the miniaturized switch invention in assembled form.
Figure 2:
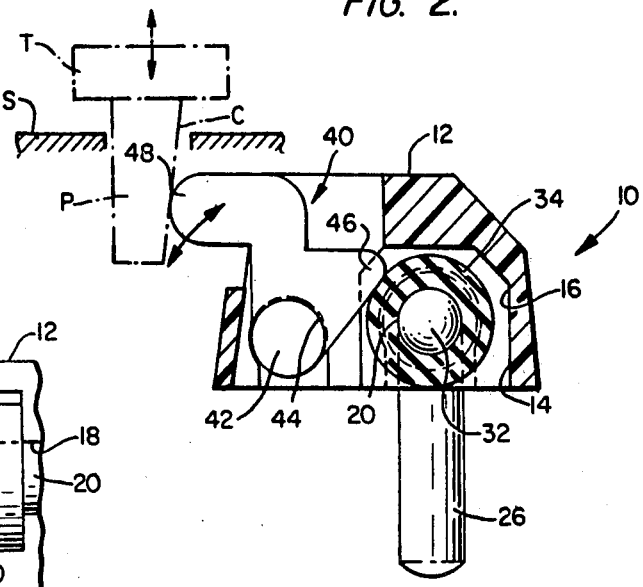
FIG. 2 is a section taken on line 2—2 of FIG. 1 showing the switch invention associated with a keyboard type mechanical operator.
Figure 4:
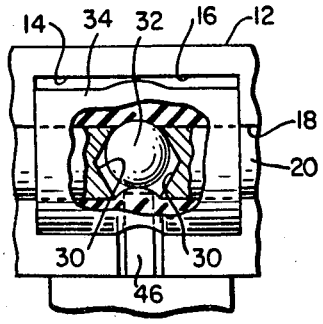
FIG. 4 is a partial bottom plan view comparable to FIG. 3 but showing the switch parts in closed condition.
Figure 3:
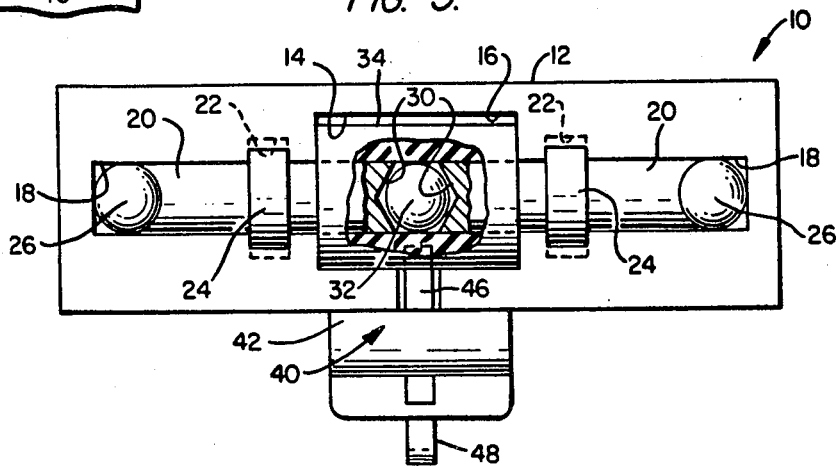
FIG. 3 is a bottom plan view of the normally open switch invention with certain switch parts broken away and shown in section.

A single miniaturized switch 10 incorporating an appropriate mechanical actuator is shown in perspective on FIG. 1 and in bottom plan in FIG. 3. FIG. 2 shows switch 10 in section as it might be associated with an appropriate mechanical operator where the switch is employed in a keyboard type application. Thus, the keytop operator and limiting stop therefore are shown in phantom lines on FIG. 2 in association with the switch 10 that is shown in section on such figure.

Miniaturized switch 10 is formed by a housing 12 having an elongated cavity 14 formed therein. For the miniaturized version contemplated, housing 12 is preferably easily formed by a single injection molded component. Thus, the cavity 14 and other shape configurations for housing 12 may be most expeditiously provided by injection molding the housing 12 to the shape desired. Further, by utilizing injection molding techniques, any desired external configuration for the housing 12 to accommodate the environment in which the switch 10 is to be employed may be simply provided for.

As may be best appreciated by the showing on FIG. 3, the elongated cavity 14 in housing 12 is made up of several segments. A central segment 16 houses the essential operating parts of the switch with narrow end segments 18 extending axially outwardly of each end of central segment 16.

Segments 18 provide pockets which retain a pair of contact members 20 for the switch 10. In the structure as best shown on FIG. 3, each pocket end segment 18 is preferably formed with an enlarged recess 22 intermediate the length of the segment 18. In turn each contact member 20 has a collar portion 24 which snuggly fits into the recess 22 of segment 18 when the contact member 20 is being assembled into the cavity 14 of switch housing 12. With the two contact members 20 having their collar portions 24 engaged in the cavity recesses 22 the ends of these contact members are held in the desired precisely spaced relation to each other to achieve optimal operating characteristics for the switch 10.

To facilitate electrically coupling the switch 10 into a circuit to be controlled, each contact member 20 is formed with a downturned connector 26. These connectors 26, extending parallel from the bottom of switch housing 12 as shown in FIG. 1, facilitate the switch 10 being connected into an electric circuit as by being soldered onto a printed circuit board. It will be appreciated that each connector 26 is simply formed on contact member 20 by bending the end of such member 90° relative to the portion of member 20 which is retained within the cavity end segment 18 and extends into the central segment 16 of cavity 14 in switch housing 12.

Referring specifically to the switch parts that are disposed within the central segment 16 of cavity 14, each contact member 20 provides a contact surface 30 to provide opposed contact surfaces between the spaced ends of contact members 20. Each contact surface 30 on an end of a contact member 20 is formed with a female conical configuration.

These opposed conical contact surfaces 30 define a space therebetween which is characterized by a peripheral portion of these surfaces being spaced a predetermined distance which is less than the spatial distance between the remainder of the areas of surfaces 30. Whereas it is preferred that both of the opposed contact surfaces be conical, it will be understood that the above-mentioned spacing characteristic between a peripheral portion of the surfaces and the remainder of the areas of such surfaces does not require that both surfaces 30 be conical or that either contact member end be conical.

A contactor member 32 of conductive material in the form of a sphere or ball is shown disposed in the space between the opposed contact surfaces 30. This member 32 requires a diameter at least as great as the above described predetermined distance which is to exist between a peripheral portion of the contact surfaces 30. This dimensional relationship ensures that when member 32 is displaced to effect closing of switch 10 it will make contact with both contact surfaces 30 with the conductive contactor member 32 forming the electrically conductive link between the two contact members 20.

A resilient sleeve 34 encloses the contact surfaces 30 that are provided on the ends of contact members 20 and also acts to encircle the contactor member 32. In the embodiment illustrated, the resilient sleeve 34 is housed within central segment 16 of cavity 14 of switch housing 12.

Important to the advantages achieved by the switch 10, the sleeve 34 totally encloses all of the active parts of switch 10. Thus, the conductive ball contactor member 32 and the opposed conical contact surfaces 30 are all protected from the exterior environment by the presence of resilient sleeve 34. Where contact members 20 are silver-plated and ball member 32 also silver-plated to give the recognized advantages of silver contacts in a switch construction, the total enclosing effect of resilient sleeve 34 essentially eliminates tarnish or corrosion of the contacting parts of the switch. The minimal amount of atmosphere trapped within the space between opposed contact surfaces 30 which is mainly occupied by contactor member 32 is insufficient to create any significant tarnish or corrosion of these silver-plated surfaces.

Although not essential in construction of switch 10 in accordance with this invention, it is preferable that the ends of contact members 20 which provide the opposed contact surfaces 30 be circular and that, where the contactor member 32 is spherical in the form of a ball, the ball be of a diameter substantially equal to the circular diameter of these contact member ends. With this relationship, the resilient sleeve 34 defines an inner cylindrical wall which encircles and to a limited extent frictionally restrains and controls member 32 in the space between opposed contact surfaces 30. In FIGS. 3, 4, 5 and 6, this relationship, common to all illustrated embodiments, results in the resiliency of the sleeve tending to hold the contactor member out of engagement with at least one of the opposed contact surfaces of the contact members. This gives the switch a normally open condition which is desired in a multitude of applications to which these switches may be applied, particularly in keyboard environments as mentioned hereinabove.

Whereas this size relationship between the contact member ends and the contactor member disposed therebetween is preferred, the conductive contactor member could be somewhat larger or smaller than the dimensions of the contact member ends. Obviously the contactor member cannot be sufficiently large as to continually engage both contact member ends nor so small as to be unable to bridge the space between the closest spaced portions of these contact member ends. Importantly, the resiliency of the sleeve offers the capability of applying force through the sleeve to the contactor member to displace such member and effect closing of switch by engagement between contact members and the conductive contactor member.

A suitable mechanical actuator means is shown on the drawing associated with housing 12. This actuator means is in the form of a trigger 40 which is pivotally mounted on its stub shaft 42 by being snapped into a pocket 44 formed on the underside of the molded plastic housing 12 of switch 10. Trigger 40 may take a variety of configurations and may itself be of molded plastic. It has a pressure finger 46 which as shown on FIG. 2 is related to the pivot axis provided by stub shaft 42 of trigger 40 such that when trigger 40 is actuated, pressure finger 46 will apply switch actuating force generally radially against the exterior of resilient sleeve 34 to thereupon displace contactor member 32 within the sleeve and effect closing of the switch by engagement between the contact members and contactor member.

The end of trigger 40 opposite pressure finger 46 provides an outwardly projecting activator 48. It will be appreciated that by force application to activator 48, the trigger will be pivoted about its stub shaft 42 such as to urge pressure finger 46 radially against the exterior of resilient sleeve 34 to effect closing of the switch. Such an activated closed condition for switch 10 is shown on FIG. 4. From this figure it will be seen that pressure finger 46 has applied force through sleeve 34 such as to displace ball contactor member 32 into engagement with both of the opposed contact surfaces 30. The opposite inner wall portion of sleeve 34 can yield, if need be, by reason of its resiliency for the material of sleeve 34 to assume the state diagrammatically illustrated on FIG. 4.

An important feature of the invention stems from the resilient material of sleeve 34 allowing excessive mechanical force which could be applied through a trigger 40 to be dissipated without creating undue or abrupt concentration of force engagement between the contactor member 32 and contact surfaces 30. The sleeve 34 may be made of an appropriate silicone rubber and excess force applied through a pressure finger such as 46 on trigger 40 will merely squeeze the rubber without damaging the contact between the switch members which could possibly destroy the operability of switch 10.

On FIG. 2 the switch 10 of this invention is shown, solely for purposes of illustration, in relation to an operating cam plunger P as it might be in an actual keyboard application environment. Utilizing an actuator means in the form of a mechanical force applying trigger 40 which is associated with housing 12 of switch 10, operator plunger P having a cam surface C could be reciprocably mounted relative to the end of activator 48 as shown in phantom lines on FIG. 2.

In such a keyboard application, the reciprocable plunger P would carry a conventional keytop T. A limit stop S, diagrammatically shown on FIG. 2, could conventionally be provided so that the force manually applied in depressing keytop T would be absorbed by the keytop and parts associated therewith engaging against abutment stop S. This would isolate the application of excessive forces to the keytop T by the keyboard user from being transmitted to the components of switch 10, forces that might damage or destroy switch 10 if directly applied to resilient sleeve 34 in displacing contactor member 32 into engagement with opposed contact surfaces 30. At the same time the downward reciprocating movement of operating plunger P caused by depression of keytop T will result in its cam surface C pressing against activator 48 to pivot trigger 40 about its stub shaft 42, moving pressure finger 46 of the trigger radially against the exterior of resilient sleeve 34 and thereby effecting closing of the switch 10 by engagement of the members enclosed within sleeve 34.

Indeed, the downward reciprocation of operating plunger P in a keyboard environment as diagrammatically illustrated on FIG. 2 may be in the order of ten to twenty times the amount of movement needed for pressure finger 46 on trigger 40 to effect switch closing. In the minaturized switch version, squeezing the switch sleeve 34 in the order of 0.008 inch can be effective to close the switch and over travel of pressure finger 46 by a few thousandths of an inch will not apply undue force between the contact surfaces within the sleeve but will be dissipated through resilient distortion of the sleeve material.

Figure 7:
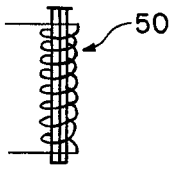
FIG. 7 is a bottom plan view similar to FIG. 3 diagramatically illustrating a magnetic force generating switch actuator.
Figure 7:
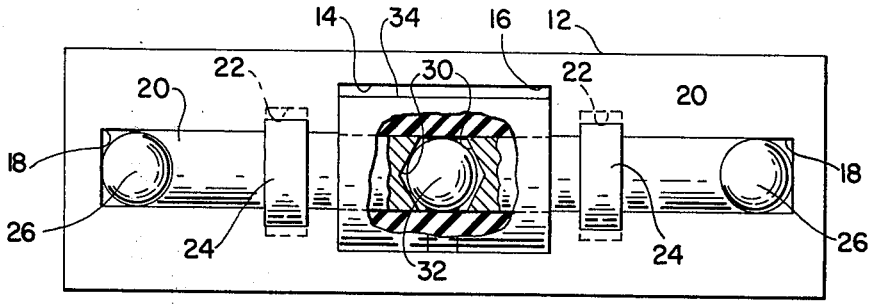

Although mechanical actuator means in the form of a trigger 40 have been illustrated and described hereinabove, the displacement of contactor member 32 to effect switch closing may be provided by an actuator means 50 associated with housing 12 to apply magnetic force through sleeve 34 to the contactor member 32. Such an embodiment is diagramatically illustrated on FIG. 7. With such an actuator means, the contactor member is made of magnetic conductive material. Desirably, the contact members 20 will also be made of a magnetic conductive material. Thus when a magnetic force generating means 50 external to resilient sleeve 34 acts on these members of magnetic conductive material the effects of magnetism act to displace the contactor 32 and draw it into contact with the opposed contact surfaces 30.

From the above description of a preferred embodiment, the advantages for the switch 10 in miniaturized form will be apparent. All of the contact surfaces of the switch are protected by being totally enclosed within resilient sleeve 34. Switch 10 may be easily constructed of a miniature size, be rugged in construction and be easily assembled from a very few low cost components.

The resilient sleeve 34, which may be of silicone rubber, serves three functions in the construction of switch 10. It protects the contact surfaces from atmosphere; it automatically controls by returning and centering the contactor member 32 so that the switch remains in a normally open condition such as desired in a majority of electronic control applications; and by virtue of its compressibility it allows over travel of an external actuating member where mechanical actuation of the switch is employed without an abrupt increase in operating force at the point of contact between the contacting members within the switch.

Figure 5:
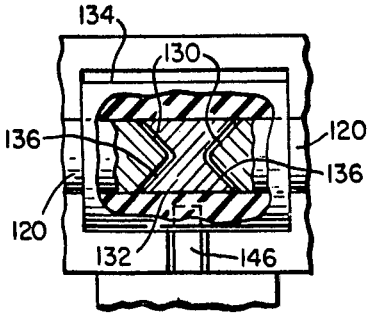
FIG. 5 is a partial bottom plan view comparable to FIG. 3 showing a modified version of the switch parts.

FIG. 5 on the drawing, shows a modified version of the switch invention having all of the advantages and characteristics possessed by the above-described embodiment for the switch illustrated on FIGS. 1–4. However, in the modified switch of FIG. 5, the contact members and the contactor member are shown in a different version to illustrate but one alternative configuration which these members may have in carrying out the concepts of this invention. Whereas, all of the switch parts in FIG. 5 function in the same manner as those hereinabove described for the first switch embodiment, the parts on FIG. 5 are numbered in a 100 series to distinguish them from the corresponding parts on the first switch embodiment.

In the FIG. 5 switch embodiment, the contact members 120 are mounted to provide opposed contact surfaces 130. Each surface 130 on the end of a contact member 120 is formed with a conical configuration. In the version shown on FIG. 5, both of the opposed surfaces 130 are defined by male cone configurations.

The contactor member 132 in the switch version of FIG. 5 is enclosed within resilient sleeve 134 to give the switch the same advantageous characteristics possessed by the above-described switch version employing a ball contactor member 32. In FIG. 5, the contactor member 132 is cylindrical, being elongated in the direction of the contact members 120. This cylindrical contactor member 132 has conically formed ends 136. As shown on FIG. 5, both ends 136 have a female conical configuration with each end 136 facing one of the opposed contact surfaces 130.

It will be recognized that similar to the first described switch embodiment, by displacing the contactor member 132 by mechanical force or magnetic force acting through sleeve 134, the contactor member 132 will move into engagement with the conical contact surfaces 130 to effect switch closing. FIG. 5 shows a portion of a pressure finger 146 that can be part of a mechanical trigger actuator means like in the first embodiment. All of the other characteristics described hereinabove for the first switch embodiment will also be possessed by the embodiment of FIG. 5 and they need not be repeated with reference to the FIG. 5 embodiment.

Whereas the FIG. 5 embodiment is specifically illustrated with male conical contact surfaces 130 on the contact members 120 and female conical ends 136 on the contactor member 132 it will be recognized that the male and female conical configurations on these switch parts could be transposed while still achieving the beneficial characteristics for the switch invention. Thus, one or both of the opposed contact surfaces 130 could have a female conical configuration with one or both of the ends 136 on contactor member 132 having a male conical configuration.

Figure 6:
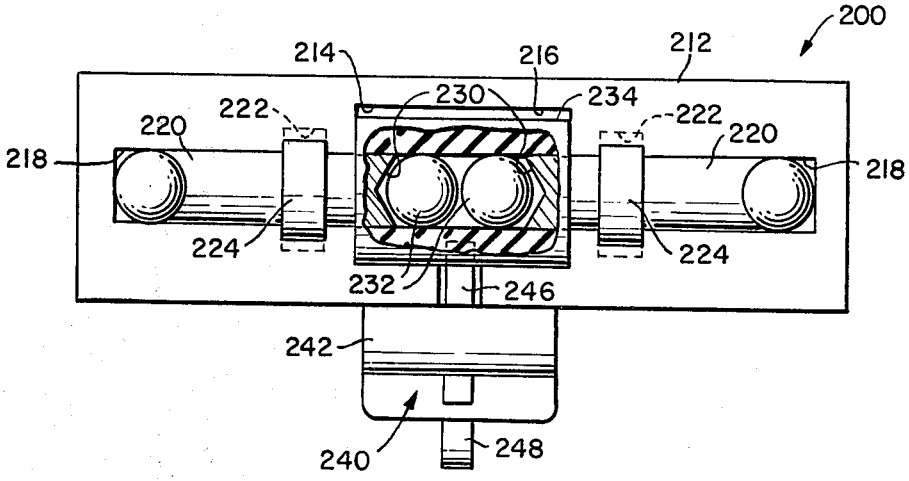
FIG. 6 is a bottom plan view similar to FIG. 3 of a normally open switch with portions shown in section to illustrate a further modified form of the conductive floating contactor member.

A second modified version of the switch invention is illustrated on FIG. 6, this version having additional advantages to those possessed by the above described embodiments. The switch parts shown in FIG. 6 function in the same manner as those hereinabove described for the first two switch embodiments with the parts on FIG. 6 being numbered in a 200 series to distinguish them from the corresponding parts on the previously described switch embodiments.

The switch 200 of FIG. 6 has a housing 212 provided with an elongated cavity 214 made up of a central segment 216 that houses the essential operating parts of the switch with narrow end segments 218 extending axially outwardly of each end of central segment 216.

A pair of contact members 220 are retained in the cavity segments 218 as by means of a collar portion 224 on each contact member snuggly fitting into an enlarged recess 222 formed intermediate the length of each segment 218. Each contact member 220 provides a contact surface 230 with the pair thus defining opposed contact surfaces between the spaced ends of contact members 220. Each contact surface 230 is preferably formed with a female conical configuration.

A resilient sleeve 234 encloses the contact surfaces 230 that are provided on the ends of contact members 220. In the FIG. 6 embodiment, the resilient sleeve 234 is housed within central segment 216 of the cavity 214 in the switch housing 212 of switch 200.

Portions of a suitable mechanical actuator means are shown on FIG. 6 associated with the housing 212. This actuator means, similar to that described hereinabove as to the other embodiments, may take the form of a trigger 240 having a stub shaft 242 by means of which it is pivotally mounted on the housing 212 with trigger 240 having a pressure finger 246 and an activator 248 all in accordance with the mechanical actuator means shown and described with reference to the earlier disclosed embodiments.

It will be recognized that all of the above described parts for the switch 200 embodiment of FIG. 6 are directly comparable to those heretofore described with reference to the first embodiment principally illustrated on FIG. 3. However, in the FIG. 6 embodiment a different form of contactor member providing its own additional advantages is employed. In switch 200 a pair of spherical elements or balls 232 form the contactor member of the switch. The elements 232 are of conductive material and are disposed in the space between the opposed contact surfaces 230.

As in the previously described embodiments, opposed conical contact surfaces 230 define a space therebetween which is characterized by a peripheral portion of these surfaces being spaced a predetermined distance that is less than the spacial distance between the remainder of the areas of surfaces 230. Again, whereas it is preferred that both of these opposed contact surfaces be conical, it will be understood that the above mentioned spacing characteristic between a peripheral portion of the surfaces and the remainder of the areas of such surfaces does not require that both the surfaces 230 be conical or that either contact member end be conical.

In the FIG. 6 embodiment the conductive contactor member formed by the separate spherical elements or balls 232 is such that together the elements 232 define a combined length that is at least as great as the above described predetermined distance which exists between the above referred to peripheral portions of the contact surfaces 230. This dimensional relationship ensures that when the two spherical elements 232 making up the switch contactor member are displaced to effect closing of switch 200, the contactor member will make contact with both contact surfaces 230. In such state the conductive contactor member elements 232 form the electrically conductive link between the two contact members 220.

As in the previous embodiments, the resilient sleeve 234 encloses the contact surfaces 230 that are provided on the ends of contact members 220 and also acts to encircle the contactor member made up of the spherical elements 232.

A particular advantage found to be derived from the switch 200 construction of FIG. 6 derives from the fact that switch activating force applied centrally to the exterior of sleeve 234, as by means of a suitable actuator, presses the resilient material of sleeve 234 down between the spherical elements 232 making up the contactor member. Whereas this activating force effectively displaces the elements 232 within sleeve 234 both into contact with each other and also into contact with the opposed contact surfaces 230 to electrically close the switch, the resilient material making up the sleeve 234 is not directly pinched against the diametrically opposite surface portions of either spherical element 232. Rather the sleeve material is merely squeezed down between these elements 232.

The above described switch actuation effects in the embodiment of switch 200 as illustrated on FIG. 6 have been found to provide substantially increased switch life with minimal damage to the resilient material of sleeve 234 over an extended number of switch actuations. Consequently, greatly increased switch activations without switch failure are achieved with switch 200; these switch activations running well over ten million in switch life reliability testings.

It should be noted that with the mechanical actuator means provided by a trigger like 40 or 240, the pressure finger 46, 146 or 246 applies switch actuating force essentially radially against the exterior of resilient sleeve 34, 134 or 234, respectively. As a practical matter there is little or no relative movement circumferentially of sleeve 34, 134 or 234 where finger 46, 146 or 246 presses thereagainst. This is advantageous in minimizing wear of the sleeve which might be occasioned by the multitude of actuations to which a switch like 10 will be subjected. However, if an actuator means is employed that will apply an actuating force against sleeve 34, 134 or 234 other than radially of the sleeve diameter, in such event a protecting ring may be applied encircling the exterior of the sleeve at the point where this mechanical actuator force is to be repeatedly applied in switch closings.

It should be appreciated from the above disclosure of the invention that switch 10 is extremely uncomplicated and operates in an efficient manner with a minimum of moving parts. While the switch may find applicability primarily in keyboard applications, it will be recognized that it is subject to utilization in a multitude of environments other than keyboard applications.

Further, it is to be understood that the switch constructions of the embodiments of the invention herein shown and described must be taken only as preferred representations of the invention. Various changes and modifications in the arrangement of the components, parts, units, elements, etc. may be resorted to without departing from the disclosure of the invention or the scope of the appended claims.

I claim:

1. A switch comprising:

a housing having a cavity therein;

a pair of contact members mounted in said cavity with the ends thereof spaced to provide opposed contact surfaces, each said contact surface being defined within an area bounded by the periphery of the contact member end, and portions of said surfaces being spaced a predetermined distance with said distance being less than the spacial distance between the remainder of the areas of said surfaces;

a floating contactor member disposed between said contact surfaces having a dimension in the direction of said contact members at least as great as said predetermined distance;

a resilient sleeve enclosing said contact surfaces and the space therebetween so as to encircle and resiliently support said contactor member; and actuator means associated with said housing to apply force through said sleeve on said contactor member to displace said contactor member and said resilient sleeve to effect closing of said switch by interengagement between said members.

2. A switch as recited in claim 1 wherein said contactor member includes a spherical element.

3. A switch as recited in claim 2 wherein said contactor member comprises a pair of spherical elements encircled by said resilient sleeve.

4. A switch as recited in claim 2 wherein at least one of said contact surfaces is generally conical.

5. A switch as recited in claim 2 wherein both of said opposed contact surfaces are generally conical.

6. A switch as recited in claim 1 wherein said contactor member is elongated in the direction of said contact members.

7. A switch as recited in claim 6 wherein said contactor member is cylindrical with conically formed ends.

8. A switch as recited in any one of claims 1, 2, 3, 4, 5, 6 or 7 wherein said contact member ends are generally circular and of a diameter substantially equal to the maximum diameter of said contactor member.

9. A switch as recited in claim 8 wherein said sleeve defines an inner cylindrical wall encircling and frictionally restraining said contactor member in the space between said opposed contact surfaces.

10. A switch as recited in claim 8 wherein the wall defining said cavity and each of said contact members are formed with interengaging retaining means so that when mounted in said cavity the contact member ends position said opposed contact surfaces precisely spaced relative to each other.

11. A switch as recited in any one of claims 1, 2, 3, 4, 5, 6 or 7 wherein said actuator means includes trigger means movably carried by said housing to apply force generally radially of said resilient sleeve to displace said contactor member within said sleeve.

12. A switch as recited in claim 11 wherein said trigger means is pivotal about an axis generally parallel to said sleeve.

13. A switch as recited in any one of claims 1, 2, 3, 4, 5, 6 or 7 wherein said contactor member is of magnetic conductive material and said actuator means is provided by magnetic force generating means disposed externally of said resilient sleeve.

* * * * *